US009078498B2

(12) United States Patent
Richardson et al.

(10) Patent No.: US 9,078,498 B2
(45) Date of Patent: Jul. 14, 2015

(54) HOLDER

(75) Inventors: Curtis R. Richardson, Fort Collins, CO (US); Stephen Willes, Fort Collins, CO (US)

(73) Assignee: OTTER PRODUCTS, LLC, Fort Collins, CO (US)

( * ) Notice: Subject to any disclaimer, the term of this patent is extended or adjusted under 35 U.S.C. 154(b) by 252 days.

(21) Appl. No.: 12/895,150

(22) Filed: Sep. 30, 2010

(65) Prior Publication Data

US 2011/0073608 A1 Mar. 31, 2011

Related U.S. Application Data

(60) Provisional application No. 61/247,488, filed on Sep. 30, 2009.

(51) Int. Cl.
*A45F 5/02* (2006.01)
*A45C 11/00* (2006.01)

(52) U.S. Cl.
CPC . *A45C 11/00* (2013.01); *A45F 5/02* (2013.01); *A45F 5/021* (2013.01)

(58) Field of Classification Search
USPC ..... 224/197, 666, 930, 163, 929
See application file for complete search history.

(56) References Cited

U.S. PATENT DOCUMENTS 4,842,174 A * 6/1989 Sheppard et al. ..... 224/548
D348,981 S * 7/1994 Dill et al. ..... D3/218
D359,616 S * 6/1995 Ishibashi et al. ..... D3/218
5,537,678 A * 7/1996 King et al. ..... 340/7.63
5,555,157 A 9/1996 Moller et al.
5,573,164 A * 11/1996 Law ..... 224/483
6,029,871 A * 2/2000 Park ..... 224/197
6,176,401 B1 * 1/2001 Lim ..... 224/196
D457,308 S 5/2002 Infanti
6,752,299 B2 * 6/2004 Shetler et al. ..... 224/197
D510,659 S 10/2005 Goradesky
D548,960 S 8/2007 Tages et al.
D550,450 S 9/2007 Dong
D564,753 S 3/2008 Tages et al.
D574,819 S 8/2008 Andre et al.
D575,056 S 8/2008 Tan
D582,149 S 12/2008 Tan
D594,224 S 6/2009 Leung et al.
D594,225 S 6/2009 Leung et al.
D596,393 S 7/2009 Leung et al.
D597,089 S 7/2009 Khan et al.
D603,603 S 11/2009 Laine et al.
D606,751 S 12/2009 Andre et al.
D661,483 S * 6/2012 Weller et al. ..... D3/218
2003/0103624 A1 * 6/2003 Hu ..... 379/455
2004/0099702 A1 * 5/2004 Conner ..... 224/163

(Continued)

OTHER PUBLICATIONS

U.S. Appl. No. 29/345,175, filed Oct. 12, 2009.

(Continued)

*Primary Examiner* — Adam Waggenspack

(57) ABSTRACT

A holder for a device may have a receiver that captures an end of the device, and an engagement mechanism that may latch or secure the device into the holder. The holder may permit the device to be held in two or more different positions, and may secure the device in the holder when the holder may be oriented in several different orientations. The holder may operate in conjunction with a removable protective cover that may include features that interact with the engagement mechanism.

20 Claims, 12 Drawing Sheets

(56) References Cited

U.S. PATENT DOCUMENTS

| | | | | |
|---|---|---|---|---|
| 2004/0112143 | A1* | 6/2004 | Richardson | 73/856 |
| 2004/0262350 | A1* | 12/2004 | Batchelor | 224/413 |
| 2005/0189913 | A1* | 9/2005 | Vitanov et al. | 320/114 |
| 2006/0116183 | A1* | 6/2006 | Infanti | 455/575.8 |
| 2006/0231713 | A1* | 10/2006 | Crain et al. | 248/309.1 |
| 2007/0261978 | A1* | 11/2007 | Sanderson | 206/320 |
| 2008/0156836 | A1* | 7/2008 | Wadsworth et al. | 224/269 |

OTHER PUBLICATIONS

U.S. Appl. No. 29/345,177, filed Oct. 12, 2009.
U.S. Appl. No. 29/352,146, filed Dec. 17, 2009.
U.S. Appl. No. 61/262,848, filed Nov. 19, 2009.
U.S. Appl. No. 29/352,358, filed Dec. 18, 2009.
U.S. Appl. No. 29/352,359, filed Dec. 18, 2009.
U.S. Appl. No. 29/352,360, filed Dec. 18, 2009.
U.S. Appl. No. 29/352,362, filed Dec. 18, 2009.
U.S. Appl. No. 29/352,987, filed Dec. 30, 2009.
U.S. Appl. No. 29/352,363, filed Dec. 18, 2009.
U.S. Appl. No. 29/352,364, filed Dec. 18, 2009.
U.S. Appl. No. 29/352,365, filed Dec. 18, 2009.
U.S. Appl. No. 29/354,411, filed Jan. 22, 2010.
U.S. Appl. No. 12/648,549, filed Dec. 29, 2009.
U.S. Appl. No. 29/354,590, filed Jan. 26, 2010.
U.S. Appl. No. 29/355,559, filed Feb. 9, 2010.

* cited by examiner

HOLDER

CROSS REFERENCE TO RELATED APPLICATIONS

This patent application claims the benefit of and priority to U.S. Provisional Patent Application Ser. No. 61/247,488 entitled "Omnidirectional Holster for a Protective Case", the entire contents of which are hereby incorporated by reference.

BACKGROUND

Protective cases for electronic devices may provide impact protection, moisture protection, abrasion protection, and other types of protection to the devices. Some protective cases may be mounted on a belt clip or other attachment for wearing on the body.

SUMMARY

A holder for a device may have a receiver that captures an end of the device, and an engagement mechanism that may latch or secure the device into the holder. The holder may permit the device to be held in two or more different positions, and may secure the device in the holder when the holder may be oriented in several different orientations. The holder may operate in conjunction with a removable protective cover that may include features that interact with the engagement mechanism.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

DETAILED DESCRIPTION

A holder for a device, such as a cellular phone, may have a receiver that may capture one end of the device, and a latch for holding the device in place. The receiver may engage five of the six sides of the device. The holder may have a belt clip or other device for attaching the holder to a user's body.

The holder may be oriented in several different positions while keeping the device in the holder. In some embodiments, the holder may be able to rotate 360 degrees while keeping the device securely held until a user removes it.

The holder and latch system may be designed so that the device may be placed in the holder in more than one orientation. Some embodiments may be capable of holding a device in four or more different positions.

The holder may be designed to work in conjunction with a removable case. The removable case may be a protective case that includes features that may engage matching features in the holder. The matching features may include latch receptacles as well as a shape configured to fit into the holder's receiver.

Throughout this specification, like reference numbers signify the same elements throughout the description of the figures.

When elements are referred to as being "connected" or "coupled," the elements can be directly connected or coupled together or one or more intervening elements may also be present. In contrast, when elements are referred to as being "directly connected" or "directly coupled," there are no intervening elements present.

Figure 1:
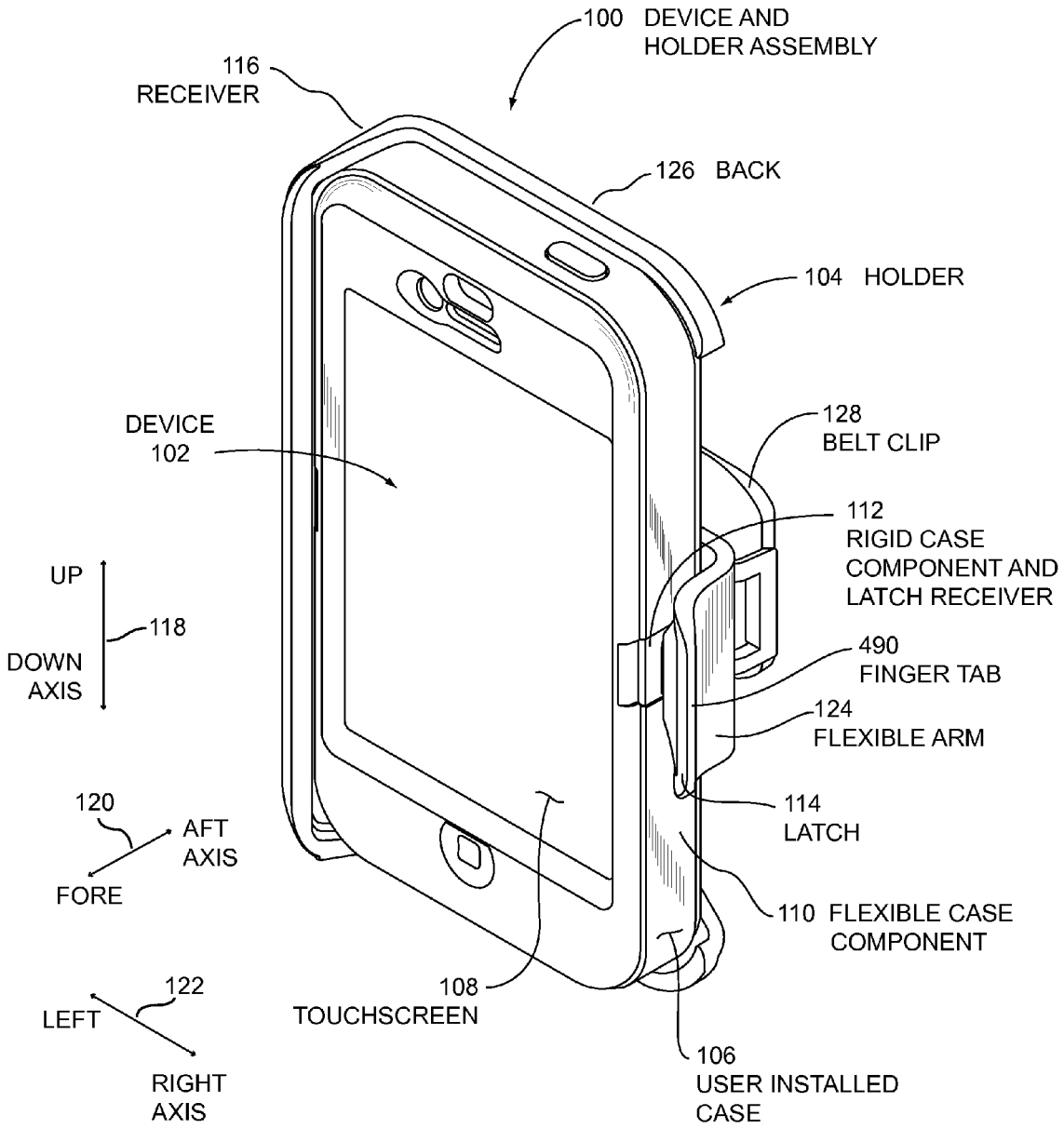
FIG. 1 is a perspective view of an embodiment showing a holder with a device installed or mounted within the holder.

FIG. 1 is a perspective view of an embodiment 100, showing a holder with a device installed or mounted within the holder. Embodiment 100 is merely one example of a design of a holder with a receiver and a latch.

Embodiment 100 is an example of a device 102 with a protective cover mounted in a holder. The device 102 may be a cellular telephone, personal digital assistant, camera, portable instrument, barcode scanner, or any other device.

A holder 104 may be mounted to a user's belt, purse, or other object and may allow the device 102 to be installed and removed from the holder 104 quickly and easily. The device 102 is illustrated as having a user installed case 106 that may operate with the holder 104 to secure the device 102 to the holder 104.

In many embodiments, the user installed case 106 and holder 104 may be a supplemental case for a commercial product. The user installed case may be an aftermarket case that a user may install after purchasing an electronic device or other item that may be covered. In many embodiments, such aftermarket cases may be installed and removed by a user.

In many embodiments, the user installed case 106 may operate as a protective cover that may insulate a device from physical damage, including mechanical abrasion such as scratches, as well as damage from dropping or other physical trauma. Some embodiments may provide protection from water, including some embodiments that may be waterproof to some depth of water.

Some embodiments may operate as aesthetic or decorative enhancements to allow a user to personalize their device. In such embodiments, the various components of a protective case may be designed with aesthetic or decorative elements, or may be manufactured with different colors, designs, or textures.

Throughout this specification, the term "user installed case" is used to describe a case or cover that may be separately installed by a consumer or user of a device. Such cases may be supplemental cases to an exterior case of a device as manufactured.

In some embodiments, the components of the user installed case may be designed to be removable. Such embodiments may provide mechanisms for the case components to snap together or otherwise engage each other, as well as a removable flexible component.

In embodiments where a user installed case may be installed in a permanent or semi-permanent fashion, the case components may be assembled using adhesives, ultrasonic welding, snap fits, or other mechanisms. In some embodiments that are installed in a permanent manner, a flexible component may be formed by injection molding the flexible component directly to the rigid component. Some such embodiments may be manufactured using a two-shot molding process.

The user installed case for the device may have a rigid component and a flexible component. The rigid component may be a rigid component that may be designed in two or more pieces in some designs. The rigid component may be manufactured from various injection molded thermoplastics, thermoset plastics, composites, metals, or other materials. The flexible component may be manufactured from a flexible, stretchable material and may be designed to wrap around the rigid component on several sides. Some embodiments may use a molded silicone, for example, which may stretch to allow installation and may wrap around several sides of a device to stay in place.

The device 102 is illustrated as having a touchscreen 108. Examples of such a device may include a cellular telephone, personal digital assistant, or other device. The case may have a rigid component over which a flexible component may be fitted. The case is illustrated as assembled to the device 102 in embodiment 100.

The case may have a flexible case component 110. The flexible component may be a molded silicone or other material that may stretch to fit over the rigid components 112. The rigid components 112 may be illustrated by the component 112 which may protrude through a hole in the flexible case component 110. The component 112 may operate as a latch receiver for the latch 114.

The holder 104 may have a receiver 116 that may engage several sides of the device 102. The receiver 116 may engage a primary side and several additional sides. In the example of embodiment 100, the primary side of the device with respect to the receiver 116 may be the far vertical side of the device 102.

When viewed from the context of projected sides of a device, the receiver 116 may form an open-topped box with a primary side having four edges, with additional sides mating to the primary side along each of the edges. The primary side may be the bottom of the open-topped box.

In some embodiments, the device 102 may have odd-shaped or curved surfaces, which may be considerably more complex than the simple, rectangular shape of the device 102. For the purposes of this specification and claims, a device having an arbitrary shape may be projected using six sided orthographic projection to form "projected sides" of the device. Throughout this specification, the term "sides" of an object refers to orthographic projected sides of the object. An illustrated example may be found in embodiment 200 presented later in this specification.

The receiver 116 may engage five sides of the device 102. The receiver may restrict movement of the device 102 in the up and down and fore and aft directions, where up and down and fore and aft are illustrated as axes 118 and 120. By engaging five sides of the device 102, the receiver 116 may capture the device 102 from moving.

In order to restrict movement in the left right axis 122, the device 102 may be held between the receiver 116 and the latch 114.

The engagement of the receiver 116 to the device 102 in each direction may be sufficient to prevent the device 102 from falling out of the holder 104. For each embodiment, the amount of contact between the receiver 116 and device 102 may be different, depending on the mass of the device 102, the anticipated shock loads experienced by the device 102 when mounted in the holder 104, the ease of installation and removal of the device 102 from the holder 104, and other considerations. Heavier devices and devices subject to more violent loading may have increased engagement between the receiver 116 and the device 102.

In a typical cellular telephone holder, the receiver 116 may provide an edge or lip of 0.050 in, 0.100 in, 0.250 in, or larger, as measured from the primary side. The lip may engage the body of the device 102 and may secure the device 102 from sliding or falling out of the holder 102.

The receiver 116 is illustrated as having a continuous surface that may contact the device 102 along five sides of the device. In some embodiments, the receiver 116 may be discontinuous and may have cutouts, finger grips, or other features formed from voids in the receiver 116. In some such embodiments, the receiver 116 may be formed of two or more fingers that engage one or more sides of the device.

In some embodiments, the receiver 116 may loosely hold the device 102. Such embodiments may have dimensional differences between the receiver 116 and the device 102 of 0.010 in, 0.025 in, 0.050 in, or larger so that the device 102 fits loosely within the receiver 116.

The receiver 116 may be designed so that the device 102 may rotate within the receiver 116 during installation and removal. In such embodiments, one of the sides of the receiver 116 may be angled outward or given additional clearance in the direction of the rotation.

The device 102 is illustrated as being mounted inside a user installed case 106. In some embodiments, the holder 104 may be designed to operate with a user installed case 106 and may engage specific features on the user installed case 106 to mechanically hold the device 102 within the installed case 106. In some such embodiments, the holder 104 may not be capable of holding the device 102 without the device 102 being installed into a user installed case 106.

The holder 104 may have a latch 114 that may have a flexible arm 124 that may engage the rigid case component 112, which may function as a latch receiver. The latch 114 may be designed so that a user may grip the device 102 and rotate the device 102 to disengage the device 102 from the latch 114. In some cases, a finger tab 490 may be used to lessen or remove the force of the latch 114 against the latch receiver, allowing the device 102 to be removed more easily.

Similarly, the latch 114 may be designed so that the user may place the device 102 in the receiver 116 and rotate the device 102 into the holder 104. In some embodiments, the latch 114 may ride over a portion of the latch receiver and engage a recessed portion of the latch receiver to hold the device 102 in place.

The holder 104 may have a back 126 that may provide a connection for the latch 114. The back 126 may also provide a connection for a belt clip 128 or other mounting mechanism. The belt clip 128 is illustrated as a mechanism by which the holder 104 may be mounted to a person's body. In other embodiments, the back 126 may be attached to another mounting device, such as a tripod, suction cup, or other mechanism. One example of another mounting mechanism may be an articulated mechanism for mounting the holder 104 to the windshield or dashboard of an automobile.

The holder 104 may be oriented in any position and may still hold the device 102. In some embodiments, the belt clip or other mounting mechanism may have an axle on which the back 126 may rotate. Such an embodiment may allow a user to orient the device as shown in the embodiment 100, or the user may rotate the holder 104 90, 180, or 270 degrees.

In some embodiments, a detent or spring engagement mechanism may hold the rotation of the belt clip 128 or other mounting mechanism at certain positions. In a typical embodiment, the rotation may have detented position every 90 degrees or every 45 degrees. In other embodiments, the back 126 may be free spinning in relationship to the belt clip 128.

Figure 2:
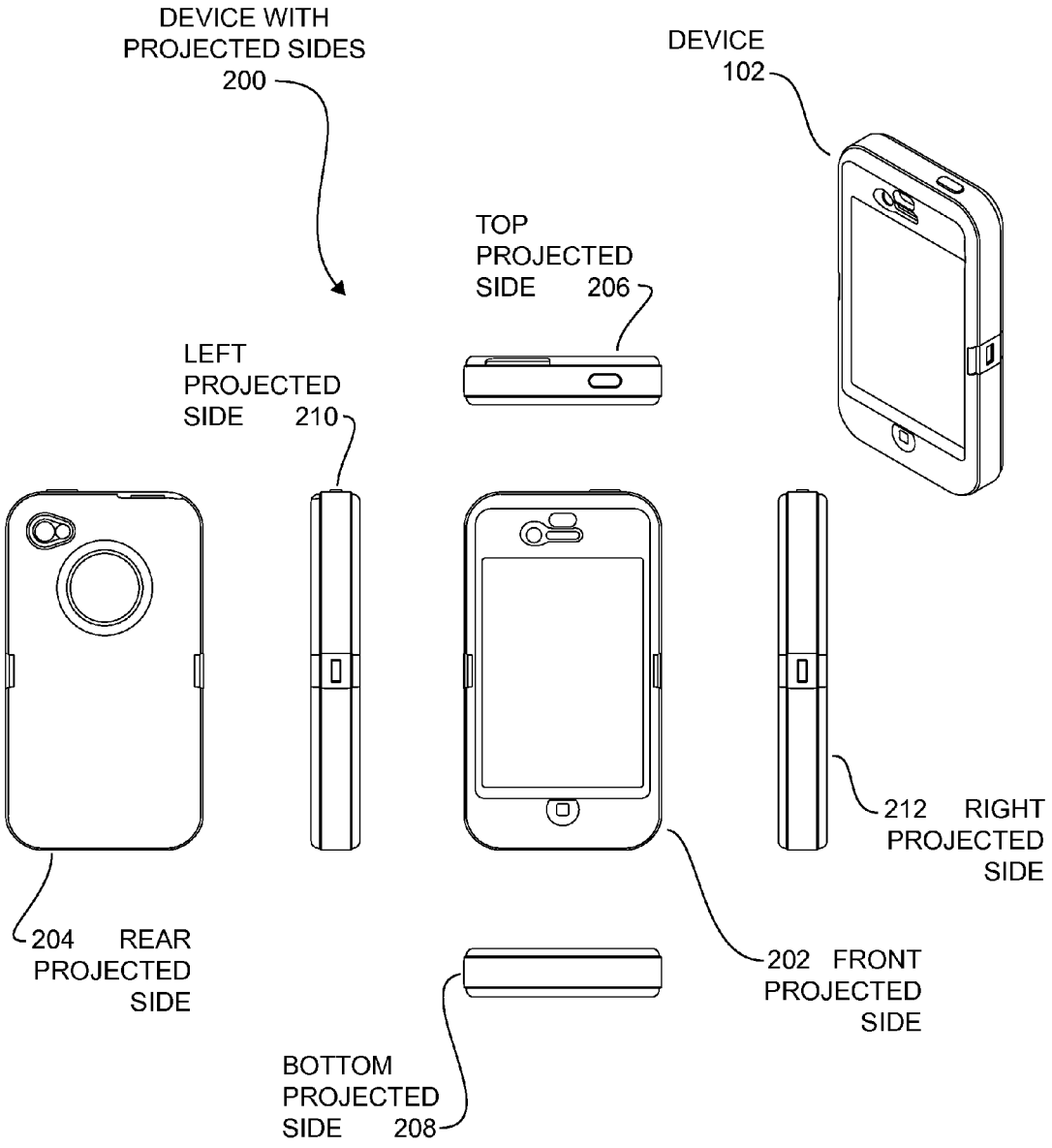
FIG. 2 is a perspective view of an embodiment showing a projected view of the device.

FIG. 2 is a perspective view of embodiment 200 showing a projected view of the device 102.

Embodiment 200 illustrates six orthographic projected sides of the device 102. The orthographic projected sides are used in this specification and claims to describe portions of a device 102 in relationship to a holder, among other reasons.

Orthographic projection is a technique where an object may be projected against planes oriented at right angles to each other. Using such a technique, a 'side' of an object of arbitrary shape may be described, even if the object has a 'side' that is complex, spherical, or has another shape.

In embodiment 200, the device 102 is shown with a front projected side 202 and a rear projected side 204. A top projected side 206 and bottom projected side 208 are also illustrated, along with a left projected side 210 and right projected side 212.

Using the terminology of embodiment 200, the receiver 116 of embodiment 100 may be said to have a primary side adjacent to the left projected side 210 of device 102. The additional sides that receiver 116 may contact may be said to be the front projected side 202, the rear projected side 204, the top projected side 206, and the bottom projected side 208. The latch 114 may engage a portion of the right projected side 212.

The labeling of top, bottom, left, right, front, and rear is arbitrary and not meant to convey any meaning other than to differentiate one projected view from another.

Figure 3:
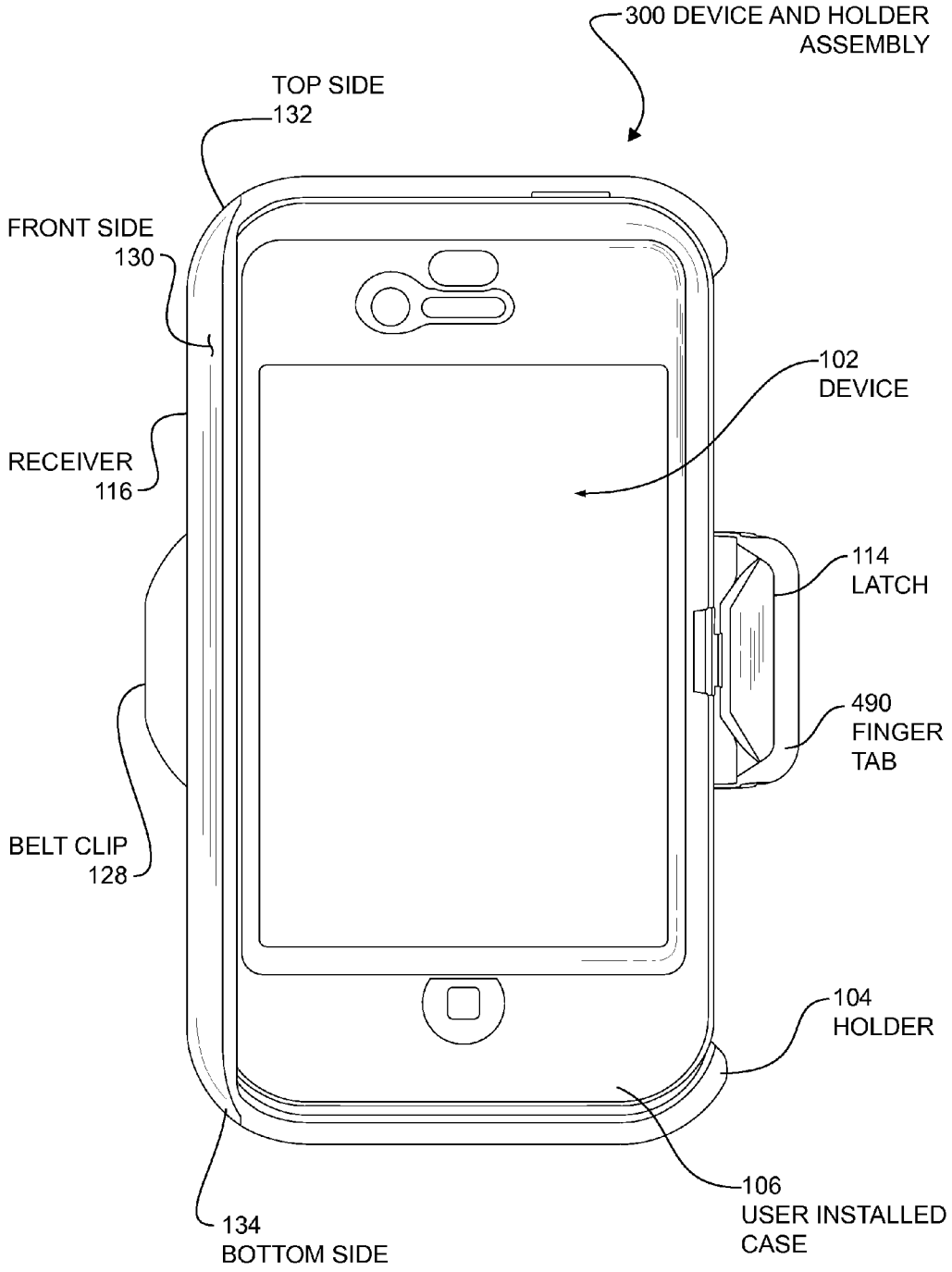
FIG. 3 is a front view of the assembly of an embodiment.

FIG. 3 is a front view of the assembly of embodiment 100.

The device 102 is illustrated as being mounted in a user installed case 106, which is assembled into a holder 104 and held by the latch 114.

The receiver 116 is illustrated as engaging the left hand side of the device 102 and surrounding the left hand side of the device 102 with a primary side and four additional sides. Of the four additional sides, the front side 130, top side 132, and bottom side 134 are viewable.

Figure 4:
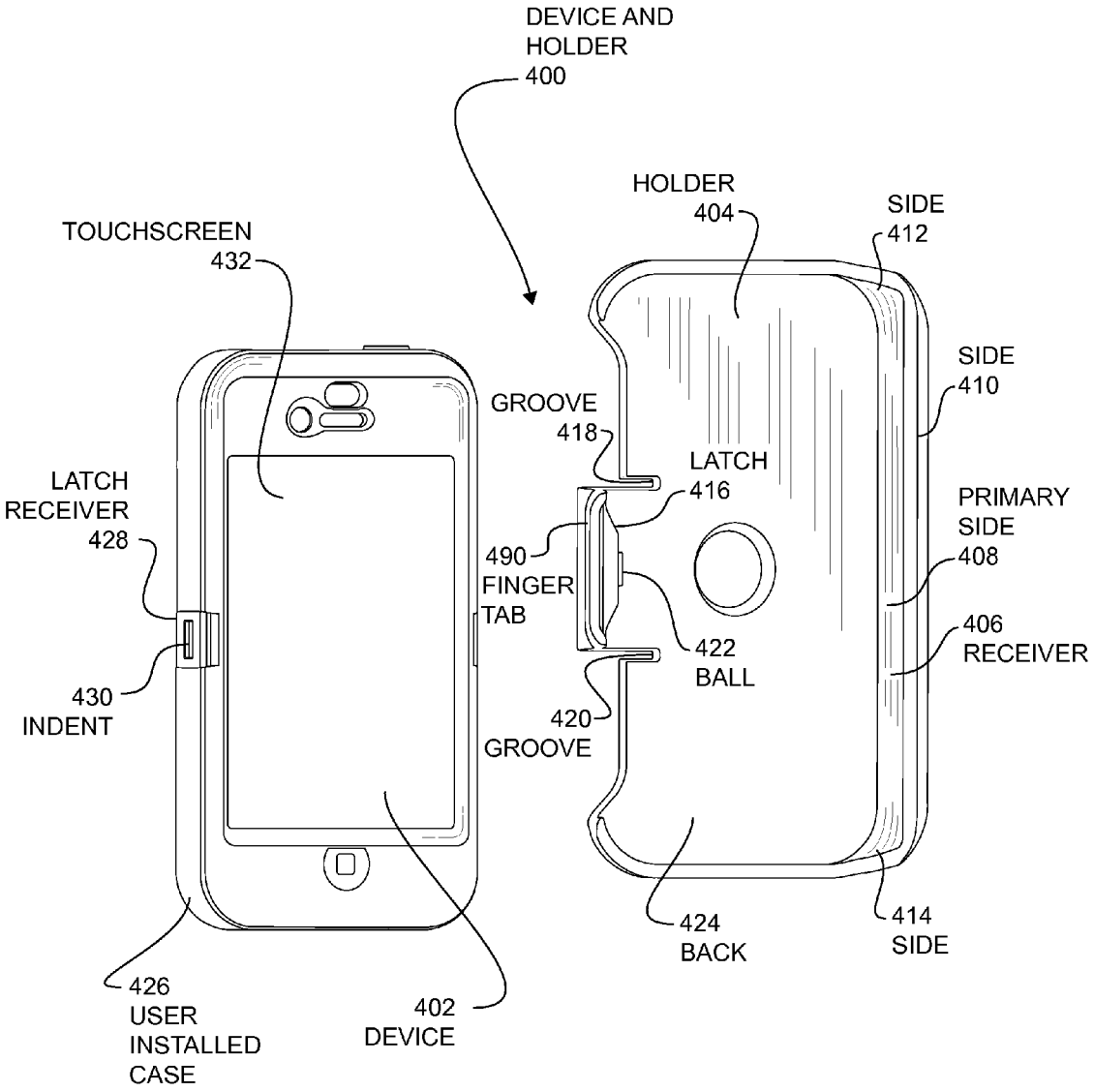
FIG. 4 is a perspective illustration of an embodiment showing a second example of a holder and case system with a device and holder.

FIG. 4 is a perspective illustration of an embodiment 400 showing a second example of a holder and case system with a device 402 and holder 404. Embodiment 400 is an example of the device 402 and holder 404 separated from each other. Embodiments 500, 600, 700, and 800 presented later in this specification may show the assembly of the device 402 and holder 404, as well as different orientations of the device 402 with respect to the holder 404.

The holder 404 may have a receiver 406 that may engage one side of the device 402. The receiver 406 may have a primary side 408, as well as sides 410, 412, and 414, plus a side defined by the back 424. The receiver 406 may engage a side of the device 402 and prevent relative movement between the device 402 and holder 404.

The holder 404 may have a latch 416 that may provide some spring force by a bending beam spring design. The bending beam spring may be defined by the grooves 418 and 420. The latch 416 may have a ball 422 that may engage the device 402.

The device 402 may have a user installed case 426. A latch receiver 428 may have an indent 430 that may engage the ball 422 of the latch 416.

Many devices may have touchscreens, such as the touchscreen 432. When installed in the holder 404, the device 402 may be oriented with the touchscreen 432 facing out or away from the back 424. In such an orientation, the touchscreen may be visible when the device 402 is installed in the holder 404. In another orientation, the device 402 may be installed in the holder 404 with the touchscreen 432 facing the back 424. In such an orientation, the touchscreen 432 may be protected from damage when mounted in the holder 404.

Figure 5:
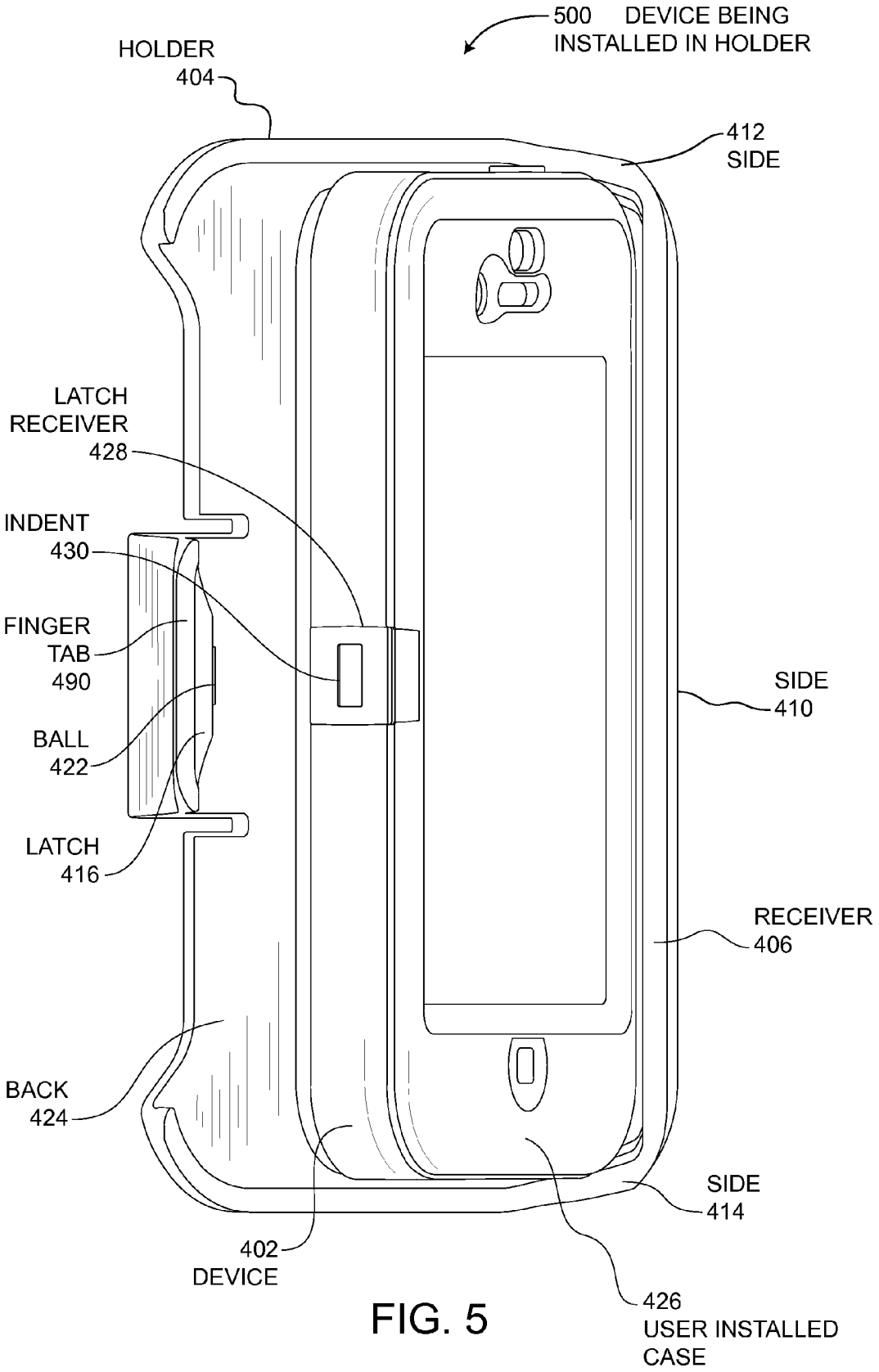
FIG. 5 is a perspective illustration of an embodiment showing the device being installed in the holder.

FIG. 5 is a perspective illustration of an embodiment 500 showing the device 402 being installed in the holder 404. Embodiment 500 may show the device 402 being held by a receiver 406 and being installed or removed by rotating the device 402 within the receiver 406 so that the latch 416 engages a latch receiver 428.

The elements of embodiment 500 are the same elements as embodiment 400.

The holder 404 is illustrated with a receiver 406 that may capture one side of the device 402 along a primary side, then capture the device 402 with sides 410, 412, 414, and the back 424. While the device 402 engages the receiver 406, the device 402 may be rotated such that the latch 416 and specifically the ball 422 may engage the latch receiver 428 and the indent 430.

Figure 6:
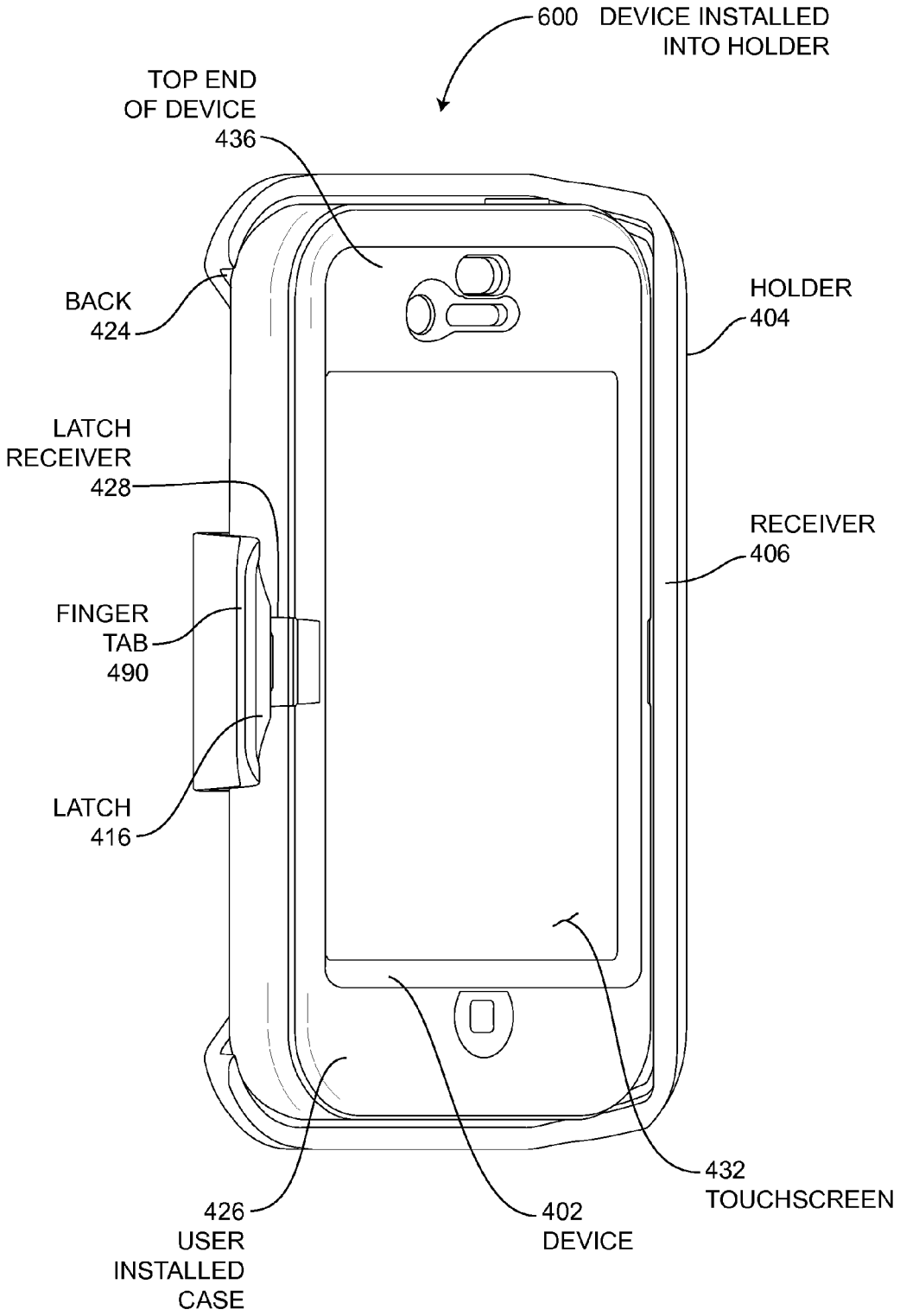
FIG. 6 is a perspective illustration of an embodiment showing the device fully installed in the holder in a first orientation.

FIG. 6 is a perspective illustration of an embodiment 600 showing the device 402 fully installed in the holder 404 in a first orientation. The device 402 is illustrated as being enclosed in a user installed case 426.

The device 402 is shown as captured in the holder 404 with one side captured by the receiver 404 and another side captured by the latch 416. The latch 416 is shown engaging the latch receiver 404.

The orientation of embodiment 600 illustrates an orientation where the touchscreen 432 is shown facing outward, away from the back 424. The device 402 is also illustrated as having the top end 426 of the device at the top of the illustration.

Figure 8:
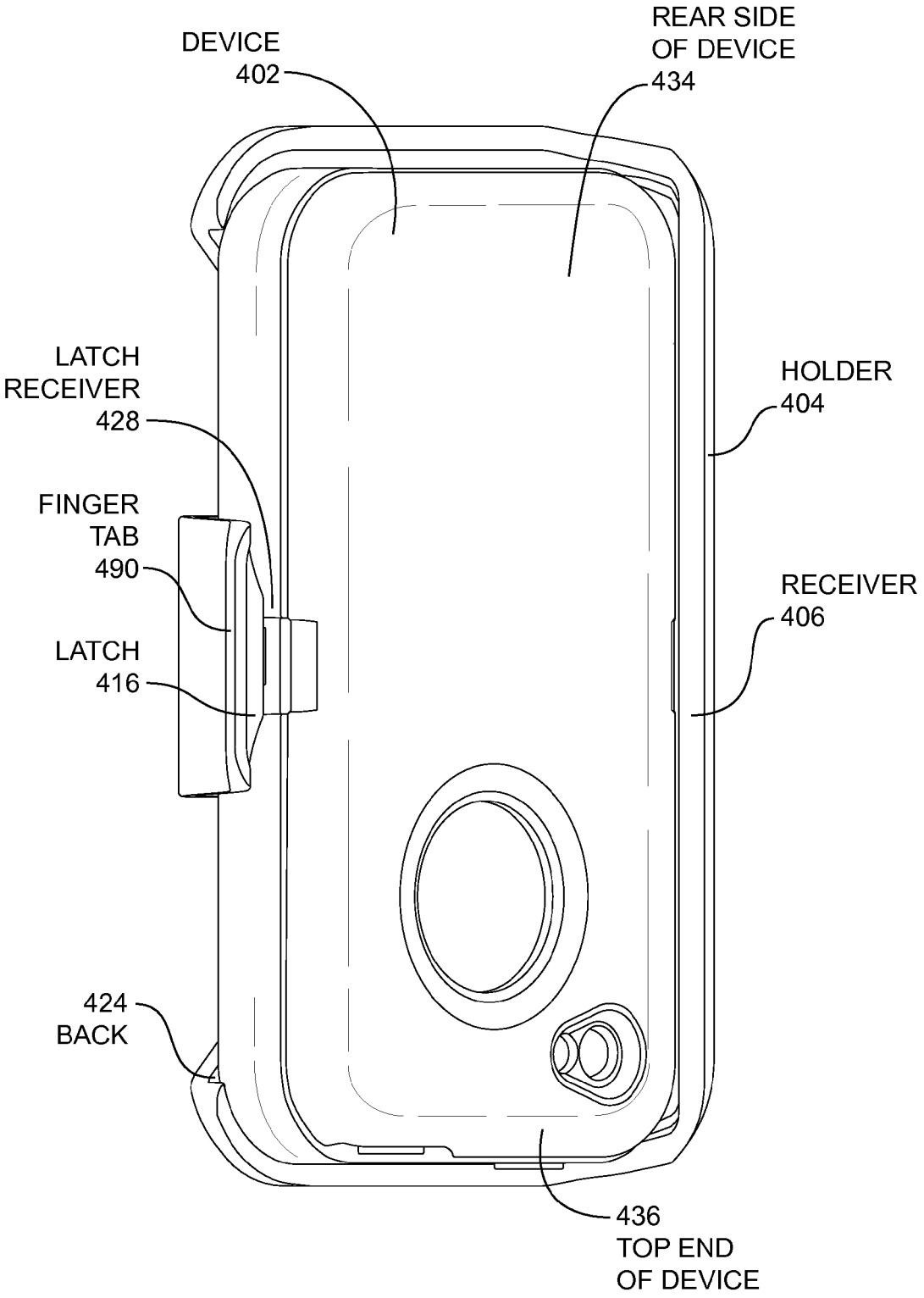
FIG. 8 is a perspective illustration of an embodiment showing the device fully installed in the holder in yet another orientation.

When the device 402 or user installed case 426 are outfitted with latch receivers 428 on two opposing sides, the device 402 may be installed with the top end 436 facing towards the top of the figure as shown in FIG. 6, or with the top end 436 oriented toward the bottom of the figure, as shown in FIG. 8. In such an orientation, the latch 416 may engage a second latch receiver 428.

Figure 7:
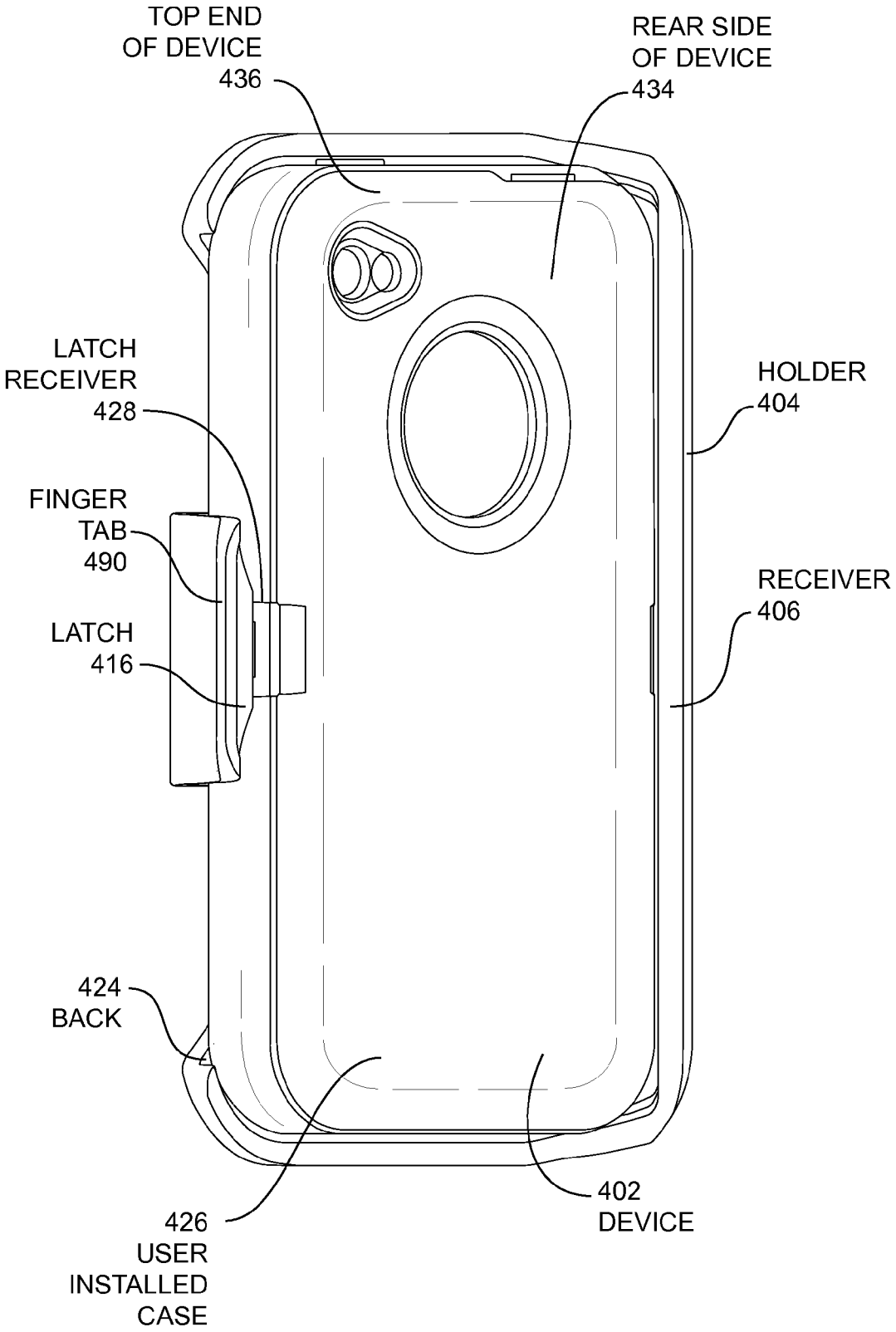
FIG. 7 is a perspective illustration of an embodiment showing the device fully installed in the holder in yet another orientation.

FIG. 7 is a perspective illustration of an embodiment 700 showing the device 402 fully installed in the holder 404 in another orientation. The device 402 is illustrated as being enclosed in a user installed case 426.

Embodiment 700 is similar to embodiment 600, but with the device 402 oriented with the touchscreen facing the back 424.

The device 402 is shown engaged and captured by the receiver 406 of the holder 402, and with the latch 416 engaged with the latch receiver 428. The device 402 is shown with a user installed case 426.

The device 402 is oriented with the top end 436 of the device oriented upwards and with the rear side 434 of the device facing outward. The orientation of embodiment 700 is an orientation in which the touchscreen of the device 402 may be protected from damage.

FIG. 8 is a perspective illustration of an embodiment 800 showing the device 402 fully installed in the holder 404 in yet another orientation. The device 402 is illustrated as being enclosed in a user installed case 426.

Embodiment 800 is similar to embodiments 600 and 700, but with the device 402 oriented with the top end of the device 402 downward.

The device 402 is shown engaged and captured by the receiver 406 of the holder 402, and with the latch 416 engaged with the latch receiver 428. The device 402 is shown with a user installed case 426.

The device 402 is oriented with the top end 426 of the device oriented downwards and with the rear side 434 of the device facing outwards or away from the back 424. The orientation of embodiment 800 is a second orientation in which the touchscreen of the device 402 may be protected from damage.

The design of the latch receivers 428 and holder 404 may use a single latch 416 that may engage two different latch receivers 428 depending on how the device 402 is oriented in the holder 404. The latch receivers 428 may be positioned at the midpoint between the top and bottom of the device 402 so that the device 402 may be oriented with the top or bottom end facing upwards, and with the touchscreen 432 facing in or out.

In some embodiments, the latch 416 and corresponding latch receivers may be positioned so that the device 402 may be oriented in two possible orientations. Such a design may be accomplished by positioning the latch and latch receiver in another location not along the midpoint between the top and bottom of the device 402, for example.

When the device 402 may be oriented in multiple orientations with respect to the holder 404, a user may be given different choices during use of the holder 402. For example, a left handed person may wish to mount the holder 404 on the left side of the user's body while a right handed person may wish to mount the holder on the right side of the user's body. In both uses, the users may wish to orient the device with the top of the device facing forward with respect to the user's body. Each orientation may be opposite of the other, and may engage different latch receivers mounted to the device.

In some embodiments, the latch receivers may be molded or formed into the device itself. In other embodiments, the latch receives may be molded or formed into the user installed case. When the latch receivers are part of the device, the user installed case may have a cutout or hole through which the latch receivers may protrude.

In other designs, two or more latches may be disposed along the same side as the latch 416. Such designs may provide additional holding or securing force to prevent the device 402 from being dislodged from the holder 404.

Figure 9:
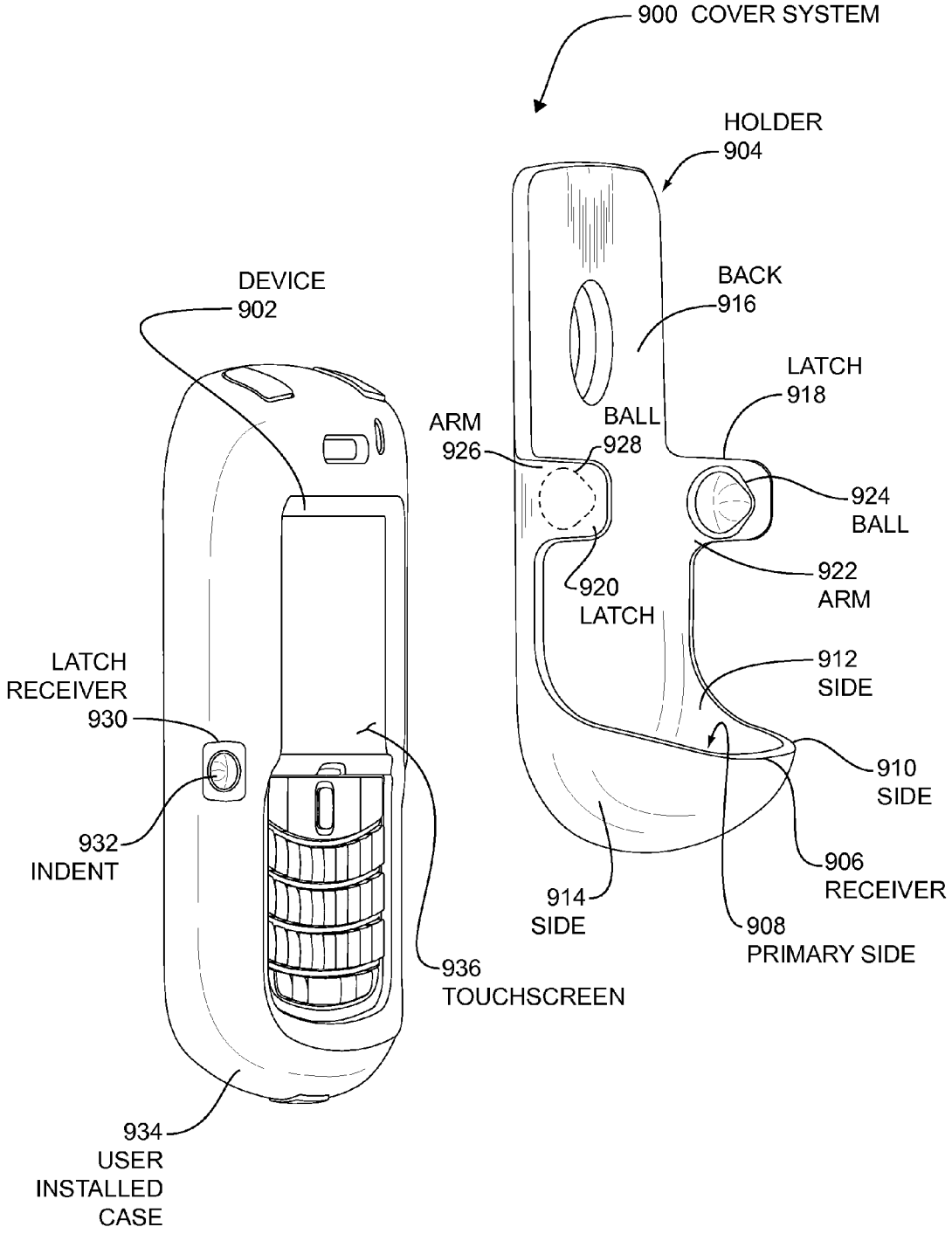
FIG. 9 is a perspective view of an embodiment showing a third embodiment with a device separate from holder.

FIG. 9 is a perspective view of an embodiment 900 showing a third embodiment with a device 902 separate from a holder 904. Embodiment 900 may operate in a similar manner as other embodiments, but two latches may be disposed on the holder on opposing sides, rather than a single latch disposed on a side opposite the primary side of a receiver.

The holder 904 has a receiver 906 that may capture and engage the smaller side of the device 902. This is in contrast to embodiment 400 where the receiver 406 may engage the longer side of the device 402.

The receiver 906 may have a primary side 906, as well as additional sides 910, 912, and 914 in addition the back 916 to capture the device 902.

In contrast to the embodiment 400, the holder 904 may have two latches 918 and 920 disposed to engage sides of the device 902. The latches 918 and 920 are oriented to engage two sides of the device 902 that are perpendicular to the primary side 908. In embodiment 400, the latch 416 may be oriented to engage a side of the device 402 that is parallel to and opposite the primary side 408.

The latch 918 may have an arm 922 which may flex, along with a ball 924 which may engage a latch receiver. Correspondingly, the latch 920 may have an arm 926 along with a ball 928, which may engage the latch receiver 930 and indent 932.

The device 902 may also have a user installed case 934 which may have the latch receiver 930 formed into the case. In some embodiments, the device 902 may include the latch receivers 930 molded or formed into the device 902.

The device 902 may have a touchscreen 936. The device 902 may be inserted into the holder 904 such that the touchscreen 936 is oriented facing the back 916 or facing away from the back 916.

Figure 10:
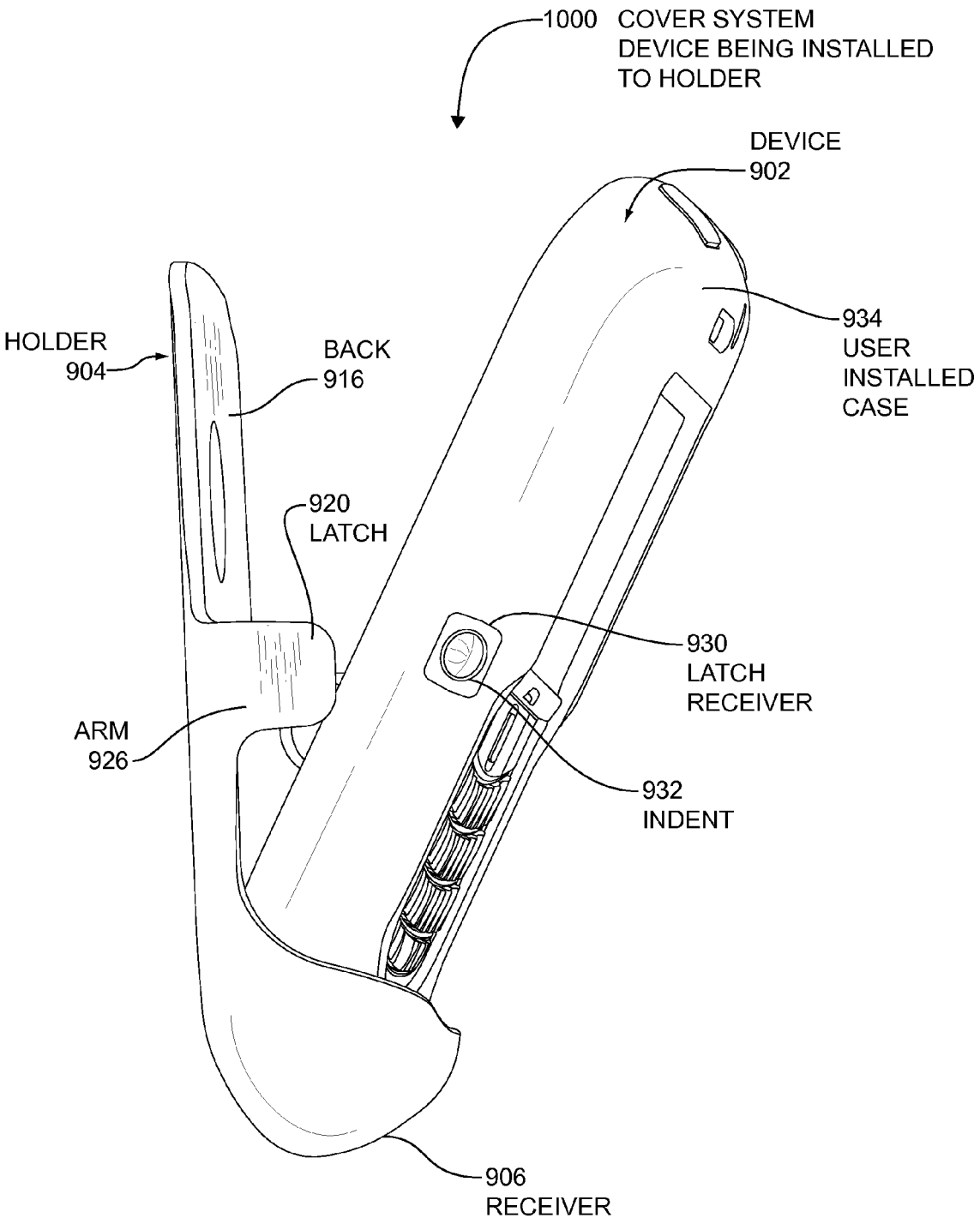
FIG. 10 is a perspective view of an embodiment showing the device being inserted into the holder.

FIG. 10 is a perspective view of an embodiment 1000 showing the device 902 being inserted into the holder 904.

The device 902 is shown engaged into the receiver 906 of the holder 904. The device 902 with the user installed case 934 may be rotated counterclockwise to engage the latch 920 with the latch receiver 930. The latch 920 may have a ball feature that may engage the indent 932. During the installation process, the arm 926 may flex to engage the indent 932.

Figure 11:
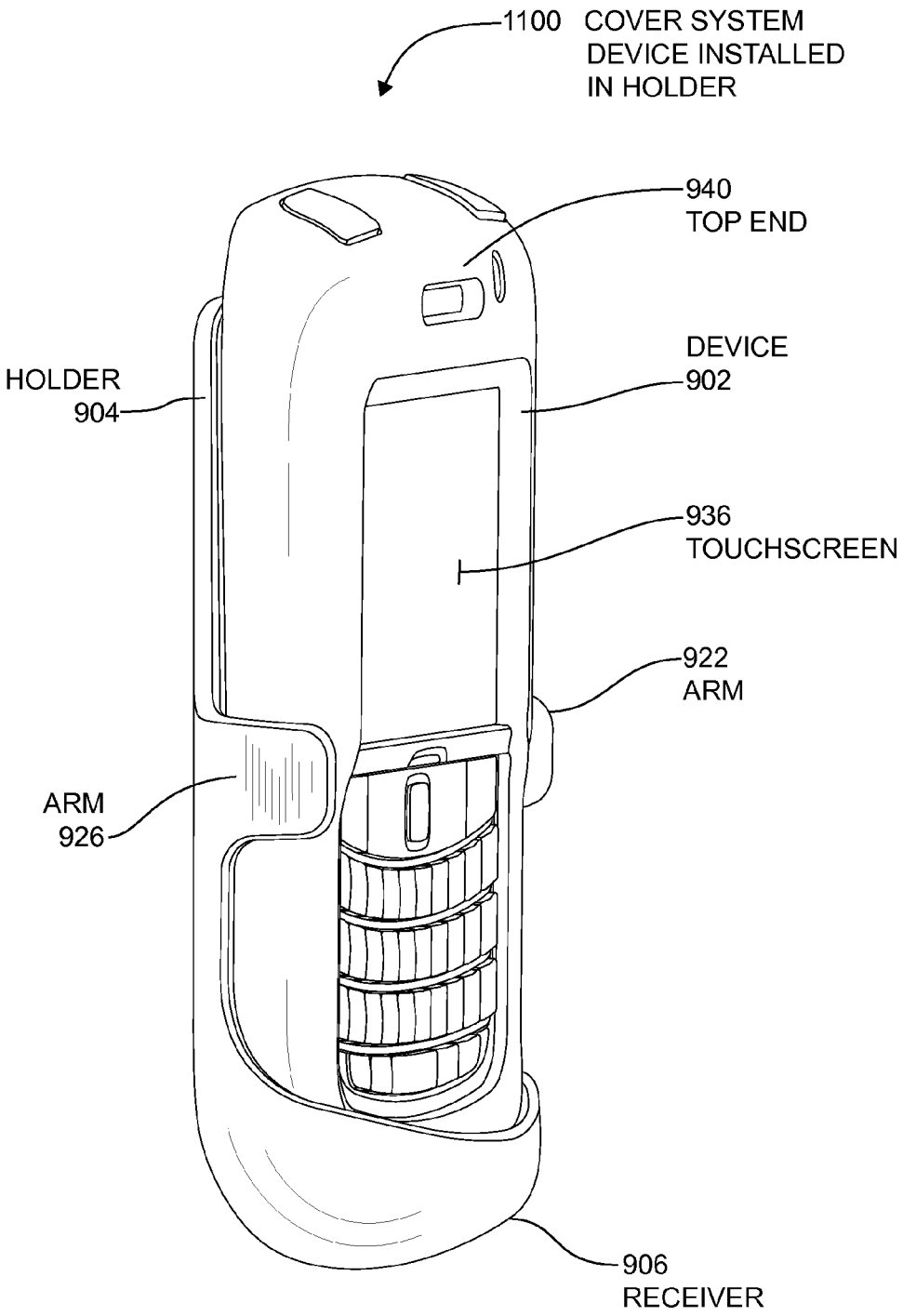
FIG. 11 is a perspective view of an embodiment showing the device fully installed into the holder.

FIG. 11 is a perspective view of an embodiment 1100 showing the device 902 fully installed into the holder 904. The device 902 is installed so that the touchscreen 936 may be facing outwards. The device 902 may have a user installed case 934 surrounding the device 902.

The bottom end of the device 902 may be captured by the receiver 906, which may prevent the device 902 from moving downwards, left or right, or frontwards or backwards from the perspective of the device 902. The arms 918 and 926 may capture the device 902 and prevent the device 902 from moving upwards, as well as rotating out of the holder 904.

The device 902 may be oriented so that the top end 940 of the device 902 is upwards. Other orientations may allow the device 902 to be oriented upside down, as well as orienting the touchscreen 936 facing towards the back where the touchscreen 936 may be protected.

Figure 12:
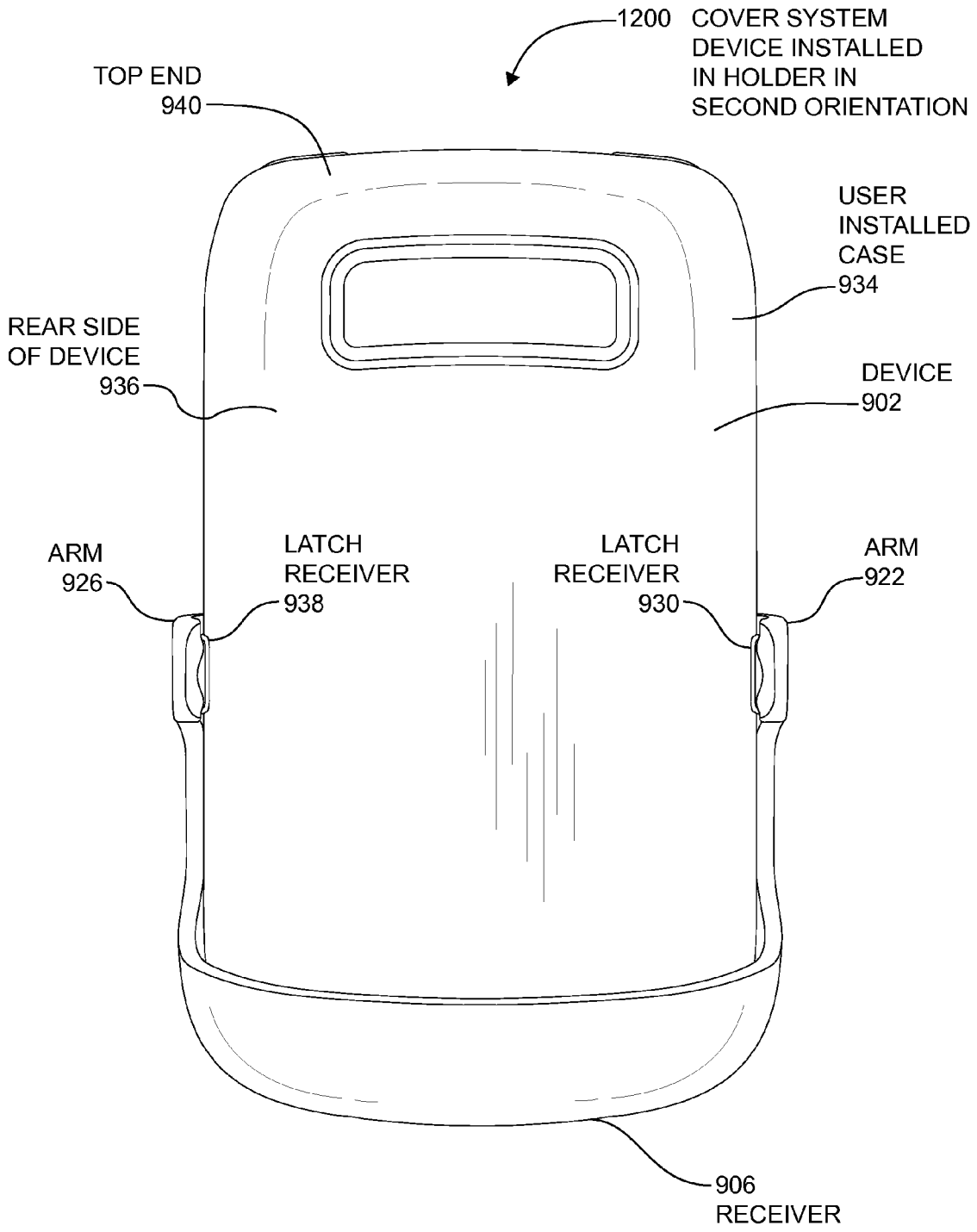
FIG. 12 is an embodiment showing the device and holder where the touchscreen may be oriented toward the back, and the rear side of the device may be exposed.

FIG. 12 is an embodiment 1200 showing the device 902 and holder 904 where the touchscreen may be oriented toward the back and the rear side 936 of the device 902 may be exposed. The device 902 may have a user installed case 934 surrounding the device 902.

The device 902 may be fully captured by the holder 904, where the bottom end of the device 902 may be captured by the holder 906 and the arms 918 and 926 may engage the latch receivers 930 and 938, respectively.

The orientation of the device 902 in the holder 904 may similar to that of embodiment 1100, but with the touchscreen of the device 902 facing the back. In the orientation of embodiment 1200, the touchscreen of the device 902 may be protected from damage.

From the view of embodiment 1200, the receiver 906 may engage the device 902 with a minimum of engagement between the various sides of the receiver 906 and the projected sides of the device 902. In some embodiments, the amount of engagement may be 0.050 in, 0.100 in, 0.250 in, or greater. In some embodiments, the engagement may be less than 0.050 in.

The holder 904 may be oriented in any direction while keeping the device 902 captured and held in the holder 904 by virtue of the latch receivers engaging mechanical features of the arms. In embodiment 900, such features were illustrated as spherical features on the arms engaging spherical detents in the latch receivers. Other embodiments may use other mechanical engagements to lock or secure the device 902 into the holder 904.

The foregoing description of the subject matter has been presented for purposes of illustration and description. It is not intended to be exhaustive or to limit the subject matter to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments except insofar as limited by the prior art.

What is claimed is:

1. An apparatus for mounting and protecting an electronic device while in a protective cover, the electronic device having a touchscreen display, the apparatus comprising:

a removable protective cover to receive, enclose, and protect the electronic device from physical damage, the removable protective cover being a supplemental case that covers an exterior surface of the electronic device, the removable protective cover including a top surface and a bottom surface being defined by a proximal end side and a distal end side, the proximal end side and distal end side each having respective lengths, the proximal and distal end sides being separated from one another by first and second opposed sides each having respective individual lengths, the two opposed sides and proximal and distal end sides together forming a perimeter of the removable protective cover, the individual lengths of the first and second opposed sides being longer than the individual lengths of the proximal and distal end sides, the top surface providing an area that permits viewing of the touchscreen display of the electronic device when the electronic device is enclosed within the removable protective cover, the first opposed side having a first latch receiver with a first indent positioned at the first opposed side's center portion, the first indent including a length and a width to receive an engagement element of a latch of a holder, the second opposed side having a second latch receiver with a second indent positioned at the second opposed side's center portion, the second indent including a length and a width to receive an engagement portion of a latch of a holder; and a holder to receive and mechanically hold the electronic device when the electronic device is enclosed within the removable protective cover, the holder having a support surface defined by a top end having a top end length, a bottom end having a bottom end length, a first side having a first side length, and a second side opposite the first side, the second side having a second side length, wherein the lengths of the first and second sides are greater than the lengths of the top and bottom ends, the holder further having a receiver extending the entire length of the first side of the holder, the receiver to receive and engage a portion of the lengths of the proximal end side and the distal end side as well as an entire length of one of either the first and second opposed sides of the removable protective cover, and a latch extending from the second side of the holder to latch with the other one of the first and second opposed sides of the removable protective cover, the latch including an engagement element to engage with the second or first indent of the respective latch receiver positioned on the respective second or first opposed side of the removable protective cover, thereby enabling holding of the electronic device in either a first orientation with the touchscreen display facing the support surface of the holder, or a second orientation with the touchscreen display facing away from the support surface of the holder.

2. The apparatus of claim 1, wherein the receiver forms an open-topped box comprising a primary side having four edges, wherein four additional sides mate to the primary side along each of the four edges, and wherein the primary side of the receiver is the bottom of the open-topped box.

3. The apparatus of claim 2, wherein one of the four additional sides of the receiver is angled outward to ease installation and removal of the removable protective cover from the holder.

4. The apparatus of claim 1, wherein the latch of the holder comprises a ball that engages the first indent in the latch receiver of the first opposed side when the removable protective cover is in the second orientation.

5. The apparatus of claim 1, wherein the latch of the holder comprises a ball that engages the second indent in the latch receiver of the second opposed side when the removable protective cover is in the first orientation.

6. The apparatus of claim 1, wherein the removable protective cover comprises a rigid component and a flexible component fitted over the rigid component.

7. The apparatus of claim 6, wherein the flexible component comprises a flexible, stretchable material, and wherein the flexible component wraps around several sides of the rigid component.

8. The apparatus of claim 1, further comprising a bending beam spring extending from the back of the holder and defined by a first groove and a second groove in the back of the holder, wherein the latch is connected to the back of the holder by the bending beam spring.

9. The apparatus of claim 1, wherein the removable protective cover is waterproof.

10. The apparatus of claim 1, wherein the electronic device comprises a barcode scanner.

11. The apparatus of claim 1, wherein the electronic device comprises a camera.

12. The apparatus of claim 1, wherein the electronic device comprises a cellular telephone.

13. The apparatus of claim 1, wherein the electronic device comprises a personal digital assistant.

14. The apparatus of claim 1, wherein the electronic device comprises a portable instrument.

15. The apparatus of claim 1, further comprising a mounting mechanism attached to the holder.

16. The apparatus of claim 15, wherein the mounting mechanism comprises a belt clip.

17. The apparatus of claim 16, wherein the mounting mechanism is rotatable relative to the back member of the holder.

18. The apparatus of claim 1, wherein the removable protective cover comprises a top member having a top surface, and a bottom member having a bottom surface to form the protective cover.

19. An apparatus for mounting and protecting an electronic device while in a protective cover, the electronic device having a touchscreen display, the apparatus comprising:

a removable protective cover to receive, enclose, and protect the electronic device from physical damage, the removable protective cover being a supplemental case that covers an exterior surface of the electronic device, the removable protective cover including a top surface and a bottom surface being defined by a proximal end side and a distal end side, the proximal end side and distal end side each having respective lengths, the proximal and distal end sides being separated from one another by first and second opposed sides each having respective individual lengths, the opposed sides and end sides together forming a perimeter of the removable protective cover, the individual lengths of the first and second opposed sides being longer than the individual lengths of the proximal and distal end sides, the top surface providing an area that permits viewing of the touchscreen display of the electronic device when the electronic device is enclosed within the removable protective cover, the first opposed side having a first latch receiver with a first indent, the first indent to engage with an engagement element of a latch of a holder, the second opposed side having a second latch receiver with a second indent, the second indent to engage with an engagement portion of a latch of a holder; and a holder to receive and mechanically hold the electronic device when the electronic device is enclosed within the removable protective cover, the holder having a support surface defined by a top end having a top end length, a bottom end having a bottom end length, a first side having a first side length, and a second side opposite the first side, the second side having a second side length, wherein the lengths of the first and second sides are greater than the lengths of the top and bottom ends, the holder further having a receiver extending the length of the first side of the holder, the receiver to receive and engage a portion of the lengths of the proximal end side and the distal end side as well as an entire length of one of either the first and second opposed sides of the removable protective cover, and a latch extending from the second side of the holder to latch with the other one of the first and second opposed sides of the removable protective cover, the latch including an engagement element to engage with the second or first indent of the respective latch receiver positioned on the respective second or first opposed side of the removable protective cover.

20. An apparatus for mounting and protecting an electronic device while in a protective cover, the electronic device having a touchscreen display, the apparatus comprising:

a removable protective cover to receive, enclose, and protect the electronic device from physical damage, the removable protective cover being a supplemental case that covers an exterior surface of the electronic device, the removable protective cover including a top surface and a bottom surface being defined by a proximal end side and a distal end side, the proximal end side and distal end side each having respective lengths, the proximal and distal end sides being separated from one another by first and second opposed sides each having respective individual lengths, the opposed sides and end sides together forming a perimeter of the removable protective cover, the individual lengths of the first and second opposed sides being longer than the individual lengths of the proximal and distal end sides, the top surface providing an area that permits viewing of the touchscreen display of the electronic device when the electronic device is enclosed within the removable protective cover, the first opposed side having a first latch receiver to engage with a latch of a holder, the second opposed side having a second latch receiver to engage with a latch of a holder; and a holder to receive and mechanically hold the electronic device when the electronic device is enclosed within the removable protective cover, the holder having a support surface defined by a top end having a top end length, a bottom end having a bottom end length, a first side having a first side length, and a second side opposite the first side, the second side having a second side length, wherein the lengths of the first and second sides are greater than the lengths of the top and bottom ends, the holder further having a receiver extending the length of the first side of the holder, the receiver to receive and engage a portion of the lengths of the proximal end side and the distal end side as well as an entire length of one of either the first and second opposed sides of the removable protective cover, and a latch extending from the second side of the holder to latch with the other one of the latch receiver of the first and second opposed sides of the removable protective cover.

* * * * *